United States Patent [19]

Strandli et al.

[11] 4,317,413

[45] Mar. 2, 1982

[54] DETONATOR ELEMENT

[75] Inventors: Kåre R. Strandli; Thomas Middleton; Jarle Fjeldstad, all of Raufoss, Norway

[73] Assignee: A/S Raufoss Ammunisjonsfabrikker, Raufoss, Norway

[21] Appl. No.: 112,121

[22] Filed: Jan. 14, 1980

[30] Foreign Application Priority Data

Jan. 12, 1979 [NO] Norway ..... 790101

[51] Int. Cl.[3] ..... F42C 9/00

[52] U.S. Cl. ..... 102/275.9

[58] Field of Search ..... 102/202, 203, 204, 205, 102/280, 275.9, 275.11

[56] References Cited

U.S. PATENT DOCUMENTS

| | | | |
|---|---|---|---|
| 2,441,248 | 5/1948 | Morris et al. | 102/280 |
| 3,162,127 | 12/1964 | Breslow et al. | 102/280 |
| 4,144,814 | 3/1979 | Day et al. | 102/202.13 |

FOREIGN PATENT DOCUMENTS

| | | | |
|---|---|---|---|
| 29415 | 2/1922 | Denmark | 102/280 |

*Primary Examiner*—Charles T. Jordan

*Attorney, Agent, or Firm*—Larson and Taylor

[57] ABSTRACT

A delay detonator element having a short delay time, especially 0.1-5.0 ms and advantageously 0.3-2.0 ms, for use in artillery ammunition and rocket warheads of caliber 40 mm or more, and which provides detonation of a secondary high explosive charge without the use of sensitive primary high explosives or detonators is characterized in that a thick-walled tube (1) having a thin-walled base contains a pyrotechnic charge (5),which upon ignition generates hot combustion gases that pass through a nozzle (4), provided between said ignition charge (5) and a subsequent pyrotechnic booster charge (3), the opening of said nozzle having a smaller cross-sectional area than the cross-sectional area of said booster charge (3), that said ignition charge (5) ignites said booster charge (3), which upon combustion yields hot combustion gases that penetrate into the secondary high explosive charge (2) and ignite it over a large area and under high pressure and high pressure gradients, resulting in a rapid transition to full detonation of said high explosive.

5 Claims, 3 Drawing Figures

DETONATOR ELEMENT

The present invention relates to a delay detonator assembly with a short delay, in the range of 0.1–5.0 ms and especially 0.3–2.0 ms, for use in explosive trains for artillery ammunition and rocket warheads of a caliber ≥ 40 mm.

A known method of constructing an explosive train assembly with delay is to load a pyrotechnic charge, normally "gasless", in front of an initial primary explosive charge, as e.g. an azide or a styphnate. Upon initiation, the pyrotechnic charge will burn at a constant rate to the primary explosive which detonates and initiates a following booster charge by detonation. The booster charge will amplify the detonation from the initial primary explosive charge and guarantee a full detonation of the main charge. The delay is achieved by the combustion of the pyrotechnic charge.

A known method of constructing an explosive train assembly without delay is to place several primary explosive detonators in series, such that the first one will detonate upon impact and transmit the detonation to the following detonator/primary explosive charges. The last one in the series will initiate a subsequent booster charge by detonation.

These delay constructions have the disadvantage that they are sensitive and require reliable safety devices. Many imaginative designs have been presented for safety devices, but they have the general disadvantage of increasing the construction costs.

Another diadvantage of the known delay assemblies is that it is difficult to achieve a reliable pyrotechnic delay of 0.3–2.0 ms which is the desired delay if a projectile is to penetrate the target skin and explode inside. The delay achieved is often too long, so that the projectile passes through the target before bursting, or too short, so that the burst occurs before the projectile has penetrated the target plate. In both cases most of the effect is lost outside the target.

It has also been proposed, in the German patent application DOS No. 27 29 540, to use a pyrotechnic delay charge to ignite an initial explosive charge consisting of a secondary high explosive (RDX or PBXN-5) and, thus, to achive a rapid pressure build-up which shears out a small metal disc. Said disc accelerates with a gas tight fit down a subsequent tube of a smaller diameter than the chamber containing the pyrotechnic delay/initial charges. The gases present in the tube are compressed by the accelerating disc. A subsequent booster charge, consisting of a secondary high explosive (PETN or RDX), is initiated by heating due to the adiabatic compression of the gases in the tube.

The invention proposed in DOS No. 27 29 540 avoids the use of sensitive primary explosives, as does the present invention thereby elimination or considerably reducing the requirements for a safety device. Data on the delay times are not given in the application, but delay times must be assumed to be considerably longer than 2 ms, since a gasless" pyrotechnic mix and relatively high loading pressures are used. No field of application is stated in DOS No. 27 29 540, but the invention has apparently been developed for use as a static detonator. Any possible disadvantages as compared to the present invention in connection with the considerable dynamic forces on a projectile during firing and impact are, thus, not known.

All previously known explosive train constructions which conclude with a detonation primary employ two known combustion mechanisms, stable layer-by-layer (conductive) combustion for delay (generally consisting of a "gasless" pryotechnic charge of low porosity) and constant full detonation, generally achieved by instantaneous detonation of a primary explosive. Initiation of a secondary high explosive by adiabatic compression of captured gases has not brought about reliable results when used in conventional artillery ammunition.

It is a main object of the present invention to provide a detonator assembly with a short delay especially of 0.5–5.1 ms and preferably of 0.3–2.0 ms, for use in explosive trains for artillery ammunition and rocket warheads of a caliber of 40 mm and more.

According to the invention this is achieved in that a pyrotechnic charge generating hot gases upon initiation is loaded in a thick-walled tube having a thin base wall. The hot combustion gases pass through a nozzle and ignite a subsequent pyrotechnic booster charge. Said booster charge is ignited over a large area due to the fact that said hot combustion gases from said ignitor charge penetrate deeply into the booster charges. Said nozzle which is provided between said ignitor charge and said booster charge, has a smaller cross-sectional area than said booster charge and limits the pressure loss during the combustion of said booster charge. Hot combustion gases from said booster charge will penetrate deeply into a subsequent secondary high explosive charge and ignite said last mentioned charge over a large area. Combustion of said secondary high explosive charge will thus, rapidly transit into full detonation.

According to the present invention a transit to full detonation is achieved in a secondary high explosive without use of sensitive primary high explosives or detonators in the explosive train. Thus, any requirements as to safety devices in the explosive train are eliminated or at least much reduced. Also, the invention secures a reliable transition to full detonation after a delay of approx. 0.3–2.0 ms.

The above mentioned disadvantages of known delay devices, i.e. difficulties in achieving reliable ignition delays of 0.2–2.0 ms and demands for expensive safety mechanisms, are practically eliminated. Furthermore, the invention eliminates the necessity of utilizing movable mechanical parts or critical dimensional tolerances. The advantages of the invention have been demonstrated in practical tests and are, thus, not theoretical results.

According to the invention a third known combustion mechanism, convective burning, is primarily utilized. Rapid flame propagation is achieved by the penetration of hot reactive gases into the unreacted mass of the subsequent charges. By limiting the pressure loss and relief against the wall, high pressure and high pressure gradients are achieved. The secondary high explosive is then ignited in the area of accelerating convective combustion. Due to pressure gradients a series of compression waves are formed which amplify the transition via low ordnance detonation to full detonation. The short delays are achieved by utilization of the induction period of ignition of the pyrotechnic charges, typically in the range of 0.1–0.5 ms.

The ignition charge or initiating mechanism provided in the assembly can be of a known kind and will ignite the booster charge by flame and hot gases. Smaller detonators involving correspondingly low demands for safety devices, can be utilized previously in the explosive train to secure transition of the ignition to an ignition charge provided in the delay assembly. The ignition charge in the delay assembly may also be ignited by electric or some other ignition, provided that the ignition does not cause detonation of the ignition charge.

In a special embodiment the build-up to full detonation may take place in two or more elements, where the first element is of the kind described above and each of the subsequent elements consist of a thick-walled tube having a thin base and loaded with a secondary high explosive. The charge of each subsequent element is ignited by shock, hot gases and fragments from the base of the preceding element.

The inside diameter of each subsequent element should be larger or equal to the inside diameter of the preceding elements. This embodiment may be used to amplify the detonation achieved in the first element or to ensure transition to full detonation in a larger amount of high explosives, where the dimensional requirements are such that the first element only provides low order detonation. The base fragments from the preceding element will penetrate deeply into the high explosive and thus enlarge the igniton area.

In another special embodiment of the invention special geometric shapes are utilized in the internal chamber of the element. In this manner, e.g. by giving the internal chamber a parabolic shape, the developing compression shock waves are focused on one point in the explosive to accelerate the transition to detonation. This provides for an element of reduced size.

Preferred embodiments of the present invention are illustrated in the drawings, wherein.

Figure 1:
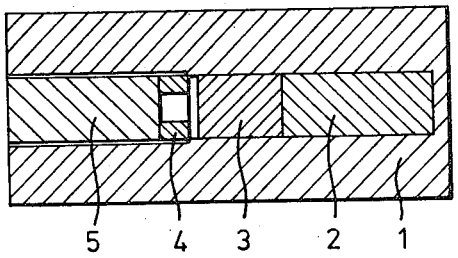
FIG. 1 is a central cross-sectional view through a delay detonator element constructed in accordance with the present invention.

FIG. 1 shows the delay detonator element in its basic configuration consisting of a thick-walled tube (1) which has a thin base and is loaded with a pyrotechnical ignition charge (5), which yields not reaction gases, a mechanical nozzle (4), a pyrotechnical booster charge (3) which generates a high gas pressure and a high temperature and a secondary high explosive (2), e.g. PETN, RDX, HMX, Tetryl or phlegmatized compositions of the same.

The ignition charge (5) may be of a known construction, e.g. a pyrotechnic charge ignited by an electrical pulse or a jet of flame. Alternatively a separate ignition mechanism of a known construction is used to ignite the pyrotechnic booster charge (3) by penetration of hot gases.

Figure 2:
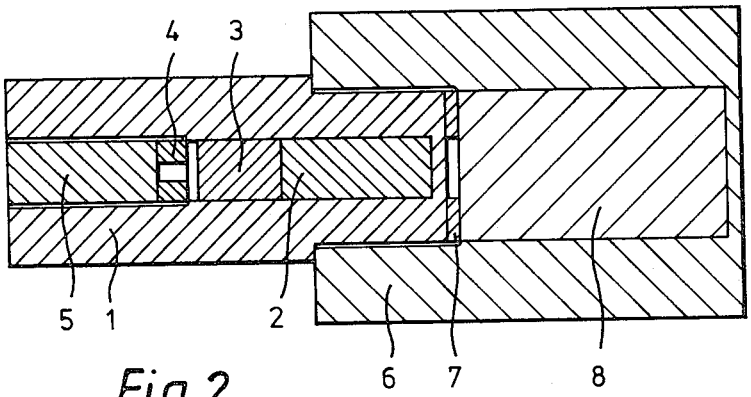
FIG. 2 is an enlarged, central cross-sectional view illustrating a modification of the present invention.

FIG. 2 shows the invention comprising two or more elements (two are shown), where a thick-walled tube (6) having a thin base wall is loaded with a secondary high explosive (8) the inside diameter of said tube being larger or equal to the inside diameter of the first element (1-5). Said tube is secured behind said first element (1-5).

Figure 3:
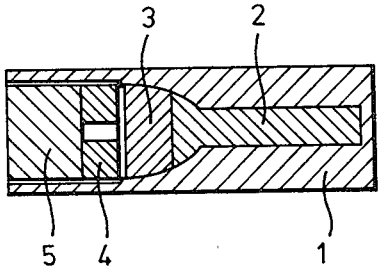
FIG. 3 is a central cross-sectional view illustrating still another embodiment of the present invention.

FIG. 3 shows an embodiment of the invention where the interior volume has a parabolic shape so as to focus to developing compression shock waves on one point of the secondary high explosive (2), and where all parts of the element (1-5) are as stated in connection with its basic configuration.

We claim:

1. A delay detonator element having a delay time of between 0.1 to 5.0 milliseconds, comprising:

a tube having side walls having a thinner, thin-walled base, a pyrotechnic ignition charge in said tube, spaced from the base, said pyrotechnic ignition charge of a composition capable of generating hot combustion gases, a nozzle positioned in the tube adjacent said pyrotechnic charge on the side thereof facing the base, said nozzle having an opening therethrough, a pyrotechnic booster charge adjacent the nozzle on the side thereof opposite from the pyrotechnic ignition change, said pyrotechnic booster charge of a composition capable of generating hot combustion gases, the said nozzle opening being smaller in cross-section than cross-section of the pyrotechnic booster charge, a secondary high explosive charge between the pyrotechnic booster charge and the said base, whereby, detonation occurs in the absence of a sensitive primary high explosive charge, as the ignition pyrotechnic charge, upon ignition, generates hot combustion gases and passes the same through the nozzle opening to ignite the pyrotechnic booster charge which then generates hot combustion gases which penetrates into the secondary high explosive charge to ignite it over a large area under high pressure and high pressure gradients, resulting in rapid transition to full detonation thereof.

2. A delay detonator means according to claim 1, in combination with a second detonator positioned to be ignited by the first said delay detonator element.

3. The combination of claim 2, said second detonator comprising a thick walled tube having a thinner, thin-walled base and an inside diameter which is at least equal to or larger than the inside diameter of the first said delay detonator element, and which is loaded with a press fit secondary high explosive which is ignited by shock and penetration of hot gases and fragments from the base of the first said delay detonator element.

4. A delay detonator element according to claim 1, wherein the cross-sectional shape of the pyrotechnic booster charge and the secondary highe explosive charge are such as to focus the developing shock waves generated upon ignition of the pryotechnic booster charge on one point of the secondary high explosive charge so as to accelerate the transition thereof to full detonation.

5. A delay detonator element according to claim 4, wherein said shape is a paraboloid of decreasing diameter from the nozzle toward the base and including a portion of the secondary high explosive charge.

* * * * *